US009562464B2

(12) United States Patent
Keene et al.

(10) Patent No.: US 9,562,464 B2
(45) Date of Patent: Feb. 7, 2017

(54) MODULAR ASSEMBLY FOR HEAT EXCHANGER

(71) Applicant: Electro-Motive Diesel, Inc., LaGrange, IL (US)

(72) Inventors: Sean D. Keene, Homewood, IL (US); Stephen E. Boucher, Woodbridge, IL (US); Matthew B. Adams, Anderson, IN (US); Scott Swenson, Willowbrook, IN (US)

(73) Assignee: Electro-Motive Diesel, Inc., La Grange, IL (US)

( * ) Notice: Subject to any disclaimer, the term of this patent is extended or adjusted under 35 U.S.C. 154(b) by 0 days.

(21) Appl. No.: 14/704,310

(22) Filed: May 5, 2015

(65) Prior Publication Data

US 2016/0326941 A1 Nov. 10, 2016

(51) Int. Cl.
*B60H 1/32* (2006.01)
*F01P 3/20* (2006.01)

(52) U.S. Cl.
CPC ..... *F01P 3/20* (2013.01)

(58) Field of Classification Search
CPC ..... F28F 9/001; F28F 2009/004; F25B 39/04; F01P 3/20; B60K 11/02; B60K 11/04; B62D 25/084
USPC ..... 105/26.05, 62.2
See application file for complete search history.

(56) References Cited

U.S. PATENT DOCUMENTS

| | | | | |
|---|---|---|---|---|
| 4,230,176 | A | 10/1980 | Crews | |
| 5,224,358 | A * | 7/1993 | Yamanaka | F25B 39/04 62/509 |
| 5,279,360 | A * | 1/1994 | Hughes | F25B 39/02 165/111 |
| 7,350,609 | B2 | 4/2008 | Udo et al. | |
| 7,370,489 | B2 * | 5/2008 | Rios | F24F 13/222 62/285 |
| 7,467,679 | B2 | 12/2008 | Honzek et al. | |
| 2004/0025813 | A1 | 2/2004 | Sasano et al. | |
| 2007/0295492 | A1 * | 12/2007 | Sharp | F28D 1/0477 165/151 |
| 2012/0131946 | A1 * | 5/2012 | Chellan | F01P 11/0276 62/434 |
| 2013/0220574 | A1 | 8/2013 | Zeolla et al. | |

FOREIGN PATENT DOCUMENTS

| | | |
|---|---|---|
| DE | 102010000356 | 8/2011 |
| JP | 11171041 | 6/1999 |
| WO | 03053768 | 7/2003 |

* cited by examiner

*Primary Examiner* — John Walters
*Assistant Examiner* — Brian Swenson

(57) ABSTRACT

A modular assembly for a heat exchanger is provided. The modular assembly includes a support assembly configured to couple to a base section of a hood structure of the heat exchanger. The support assembly includes a first slant surface and a second slant surface configured to provide support to at least a portion of the heat exchanger. The support assembly also includes a fluid reservoir integrated with and extending from the support assembly, the fluid reservoir is configured to store a fluid circulated through the heat exchanger.

19 Claims, 5 Drawing Sheets

MODULAR ASSEMBLY FOR HEAT EXCHANGER

TECHNICAL FIELD

The present disclosure relates to a heat exchanger assembly, and more particularly to a modular assembly for the heat exchanger assembly.

BACKGROUND

A heat exchanger, such, as a radiator is associated with a cooling system of an engine. A size of the radiator of the engine increases with an increase in size of the engine. The cooling system also includes a tank that may store cooling water. Further, large sized radiators require a sturdy support structure in order to hold the radiator and the tank. The tank is generally externally attached and bolted onto the support structure of the radiator.

In some applications, for example in a locomotive, it is desirable that the radiators are able to drain completely into the tank in order to prevent freeze damage. Thus, the tank has a large volume that occupies considerable compartment space. Additionally, in such systems, a weight of the tank is considerably high, owing to the tank adding to an overall weight of the system.

U.S. Published Application Number 2004/0025813 describes a front end structure and radiator support of a vehicle incorporating a sight glass for a reserve tank. The front end structure of the vehicle comprises a radiator support fixed on a vehicle body at the front end of the vehicle and to which at least a radiator is attached, a tank which is arranged in the front end of the vehicle, and behind the radiator support and accumulates fluid inside. Sight glasses by which a worker can see the level of cooling water, or the like, remaining in the tanks from the front side of the vehicle is also mounted on the radiator support.

SUMMARY OF THE DISCLOSURE

In one aspect of the present disclosure, a modular assembly for a heat exchanger is provided. The modular assembly includes a support assembly configured to couple to a base section of a hood structure of the heat exchanger. The support assembly includes a first slant surface and a second slant surface configured to provide support to at least a portion of the heat exchanger. The support assembly also includes a fluid reservoir integrated with and extending from the support assembly, the fluid reservoir is configured to store a fluid circulated through the heat exchanger.

In another aspect of the present disclosure, a heat exchanger assembly is provided. The heat exchanger assembly includes a heat exchanger. The heat exchanger assembly also includes a hood structure defining an interior space. The heat exchanger is received into the interior space of the hood structure. The heat exchanger assembly further includes a modular assembly coupled to the hood structure. The modular assembly includes a support assembly coupled to a base section of the hood structure. The support assembly includes a first slant surface and a second slant surface configured to provide support to at least a portion of the heat exchanger. The modular assembly also includes a fluid reservoir integrated with and extending from the support assembly. The fluid reservoir is configured to store a fluid circulated through the heat exchanger.

In yet another aspect of the present disclosure, an engine system is provided. The engine system includes an engine and a heat exchanger. The engine system also includes a hood structure defining an interior space. The heat exchanger is received into the interior space of the hood structure. The engine system further includes a modular assembly coupled to the hood structure. The modular assembly includes a support assembly coupled to a base section of the hood structure. The support assembly includes a first slant surface and a second slant surface configured to provide support to at least a portion of the heat exchanger. The modular assembly also includes a fluid reservoir integrated with and extending from the support assembly. The fluid reservoir is in communication with the engine and the heat exchanger. The fluid reservoir is configured to store a fluid circulated through the heat exchanger.

Other features and aspects of this disclosure will be apparent from the following description and the accompanying drawings.

DETAILED DESCRIPTION

Figure 1:
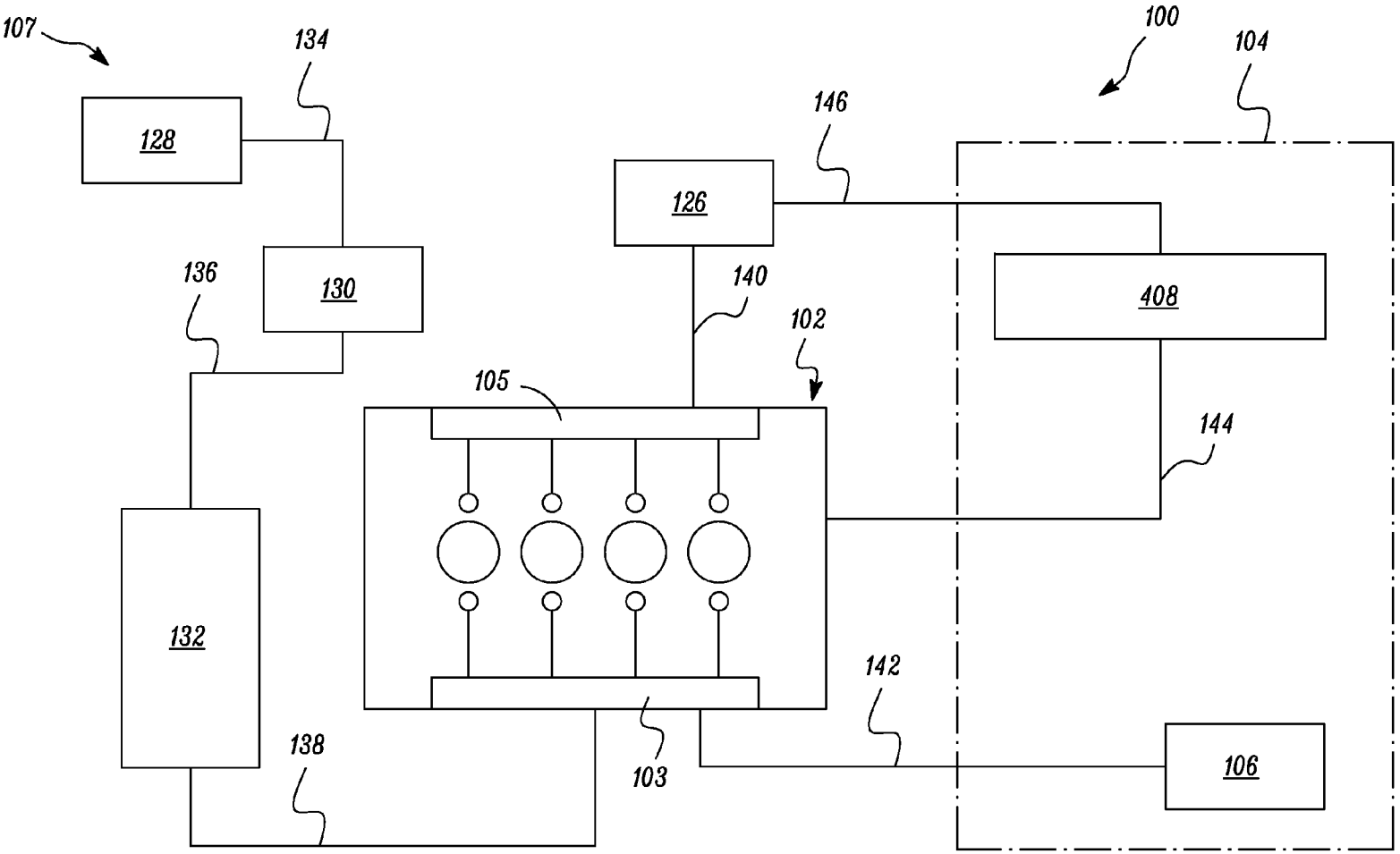
FIG. 1 is a schematic diagram of an exemplary engine system, according to one embodiment of the present disclosure.

Wherever possible, the same reference numbers will be used throughout the drawings to refer to the same or the like parts. FIG. 1 is a perspective view of an exemplary engine system 100, according to one embodiment of the present disclosure. In one embodiment, the engine system 100 may be associated with a locomotive (not shown). However, it should be noted that the application of the present disclosure is not restricted to the locomotive. The engine system 100 may be used to provide power to any machine including, but not limited to, an on-highway truck, an off-highway truck, an earth moving machine, and other similar machines.

The engine system 100 includes an engine 102. The engine 102 provides driving power to the locomotive, in order to propel the locomotive on rails (not shown). In one embodiment, the engine 102 may include, for example, a diesel engine, a gasoline engine, a gaseous fuel powered engine such as, a natural gas engine, a combination of known sources of power, or any other type of power source apparent to one of skill in the art. As shown, the engine 102 may include an intake manifold 103 and an exhaust manifold 105. The intake manifold 103 is configured to receive intake air through an air intake system 107. Products of combustion may be exhausted from the engine 102 via the exhaust manifold 105.

Ambient air may be drawn into the engine 102 through an air filter 128 of the air intake system 107. The air intake system 107 of the engine system 100 may include a turbocharger 130. The intake air may be introduced into the turbocharger 130 via line 134, for compression purposes leading to a higher pressure thereof. The compressed intake air may then flow towards an aftercooler 132 via line 136.

The aftercooler 132 is configured to decrease a temperature of the intake air flowing therethrough. In the illustrated embodiment, the aftercooler 132 is embodied as an air to air aftercooler. Alternatively, the aftercooler 132 may embody an air to liquid aftercooler. The intake air may be introduced into the intake manifold 104 via line 138. The line 138 may be fluidly coupled to the intake manifold 103.

The engine system 100 also includes an aftertreatment system 126. The aftertreatment system 126 is provided in fluid communication with the exhaust manifold 105 via line 140. The aftertreatment system 126 is configured to treat the exhaust gases exiting the exhaust manifold 105. The engine 102 may include other components (not shown) such as a fuel system.

A cooling system 104 is associated with the engine system 100. A portion of the cooling system 104 is shown in FIG. 1. The cooling system 104 may include two cooling circuits, namely an engine cooling circuit (not shown) and an aftertreatment cooling circuit (not shown). The cooling system 104 is configured to cool various engine parts. In one example, the cooling system 104 is configured to allow a fluid, such as water, to flow into the engine cooling circuit and/or the aftertreatment cooling circuit.

Figure 2:
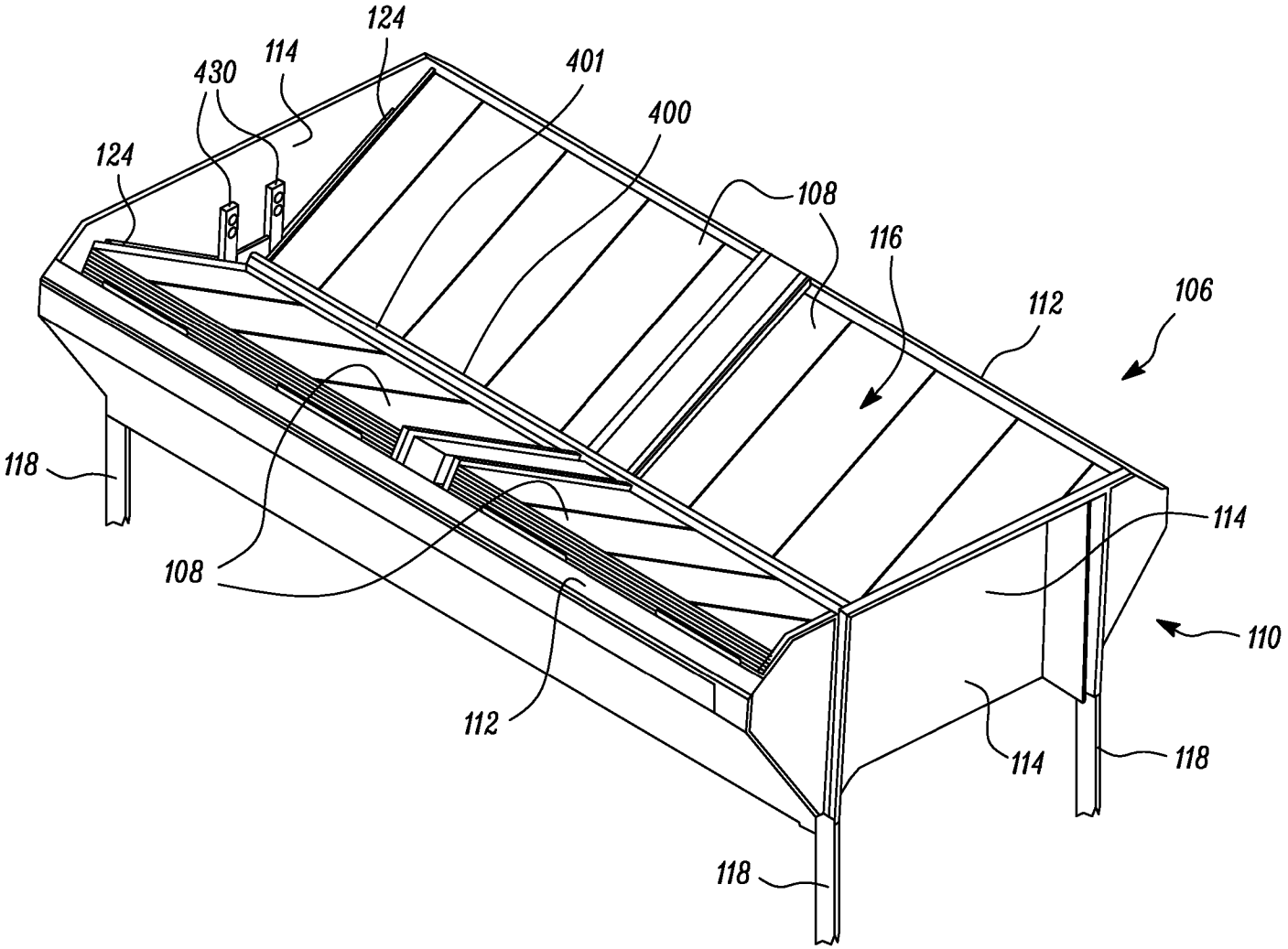
FIG. 2 is a perspective view of a hood structure provided with a heat exchanger and a portion of the modular assembly, according to one embodiment of the present disclosure.

Referring to FIGS. 1 and 2, a heat exchanger assembly 106 is associated with the cooling system 104. The heat exchanger assembly 106 is configured to exchange heat with the fluid leaving the engine 102. In one example, the heat exchanger assembly 106 may be configured to cool the water leaving the engine 102 via line 142.

As shown in FIG. 2, the heat exchanger assembly 106 includes a heat exchanger 108. In the illustrated embodiment, the heat exchanger assembly 106 includes four packs of heat exchangers 108. However, in alternate embodiments, the number of packs of the heat exchanger 108 may vary based on system requirements. The heat exchanger 108 may include heat exchanger tubes (not shown) that allow the fluid to flow therethrough. The heat exchanger 108 may embody a radiator.

The heat exchanger 108 may embody any liquid to air heat exchanger or liquid to liquid heat exchanger, without limiting the scope of the present disclosure. In one example, ambient air may flow over the heat exchanger tubes to cool the fluid flowing therethrough. In some example, fins (not shown) may be provided between adjacent heat exchanger tubes in order to increase contact surface of the heat exchanger tubes to the ambient air, thereby increasing efficiency of the heat exchanger 108.

Figure 3:
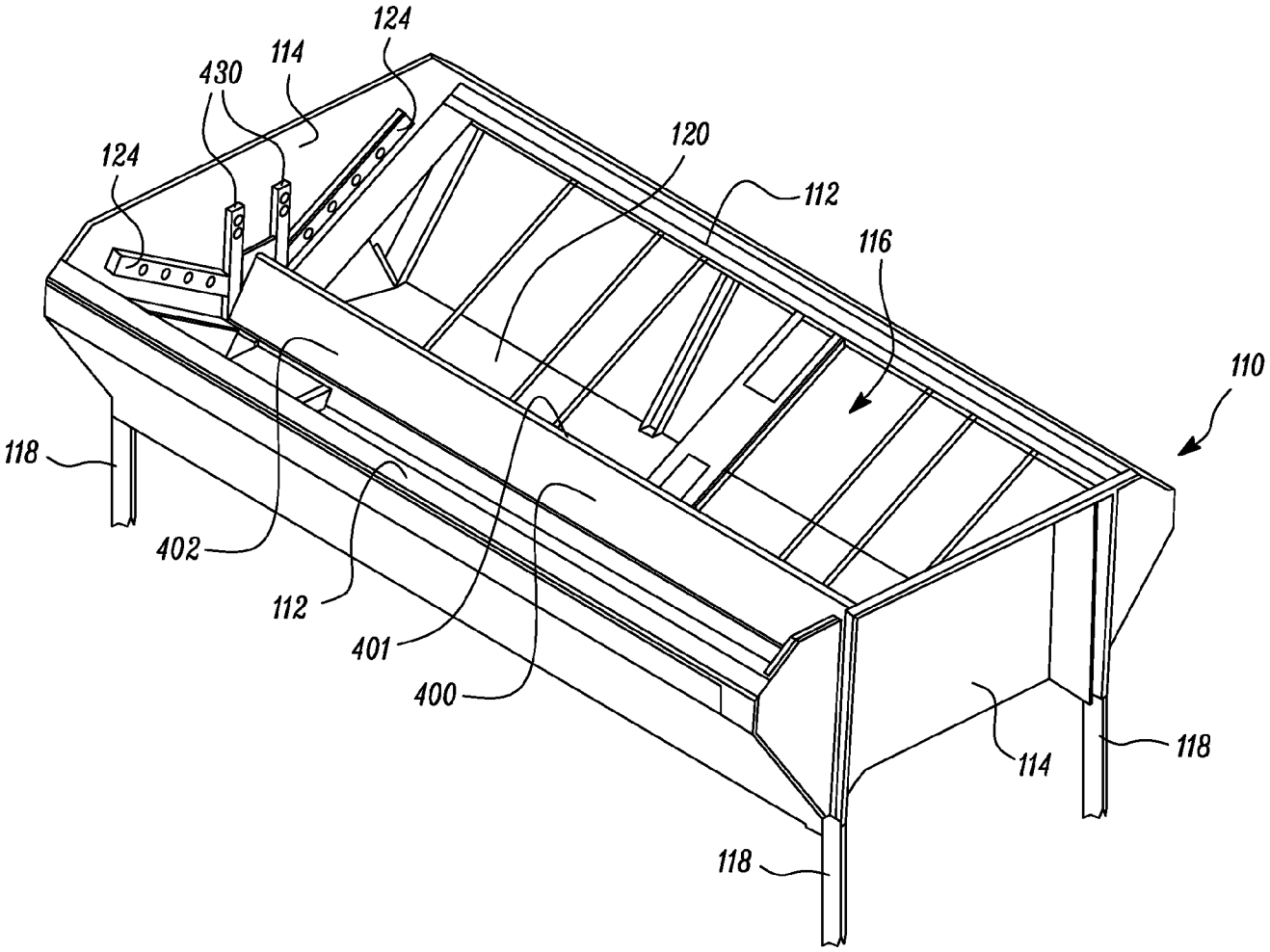
FIG. 3 is a perspective view of the hood structure and the modular assembly without the heat exchanger, according to one embodiment of the present disclosure.

Referring to FIGS. 2 and 3, a hood structure 110 is associated with the heat exchanger assembly 106. FIG. 3 illustrates the hood structure 110 without the heat exchanger 108 to depict the structure and construction of the hood structure 110 for purposes of clarity and explanation. The hood structure 110 includes frame members 112 (see FIG. 3) arranged in a V-type configuration to support the heat exchanger 108 thereon. Further, a pair of plates 114 extends between each of the frame members 112. The frame members 112 and the plates 114 of the hood structure 110 together define an interior space 116. The heat exchanger 108 is received into the interior space 116 of the hood structure 110. The hood structure 110 also includes vertical members 118 (see FIG. 2) to mount the hood structure 110 on a surface of the locomotive.

Figure 4:
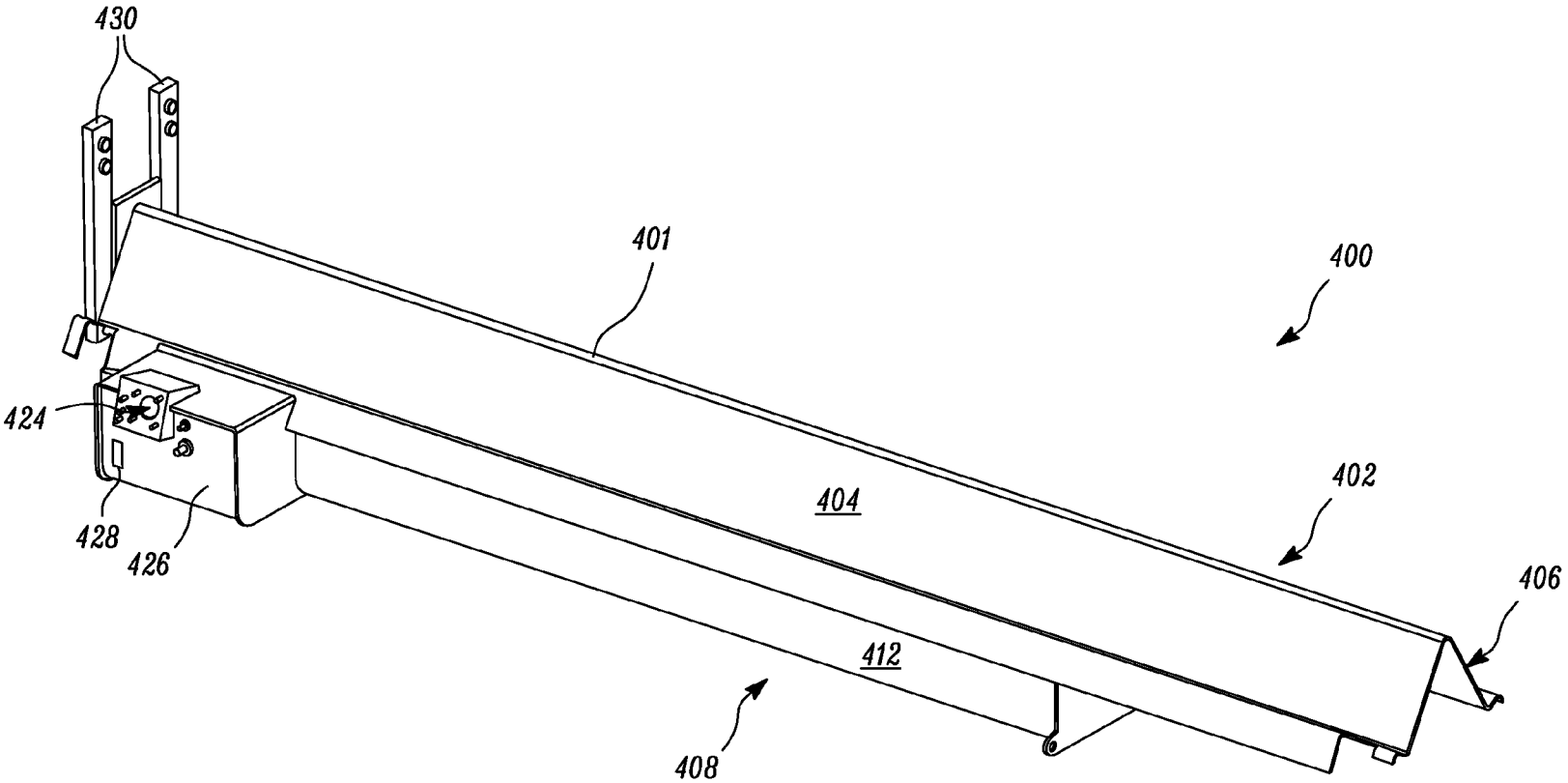
FIG. 4 is a perspective view of the modular assembly, according to one embodiment of the present disclosure.
Figure 5:
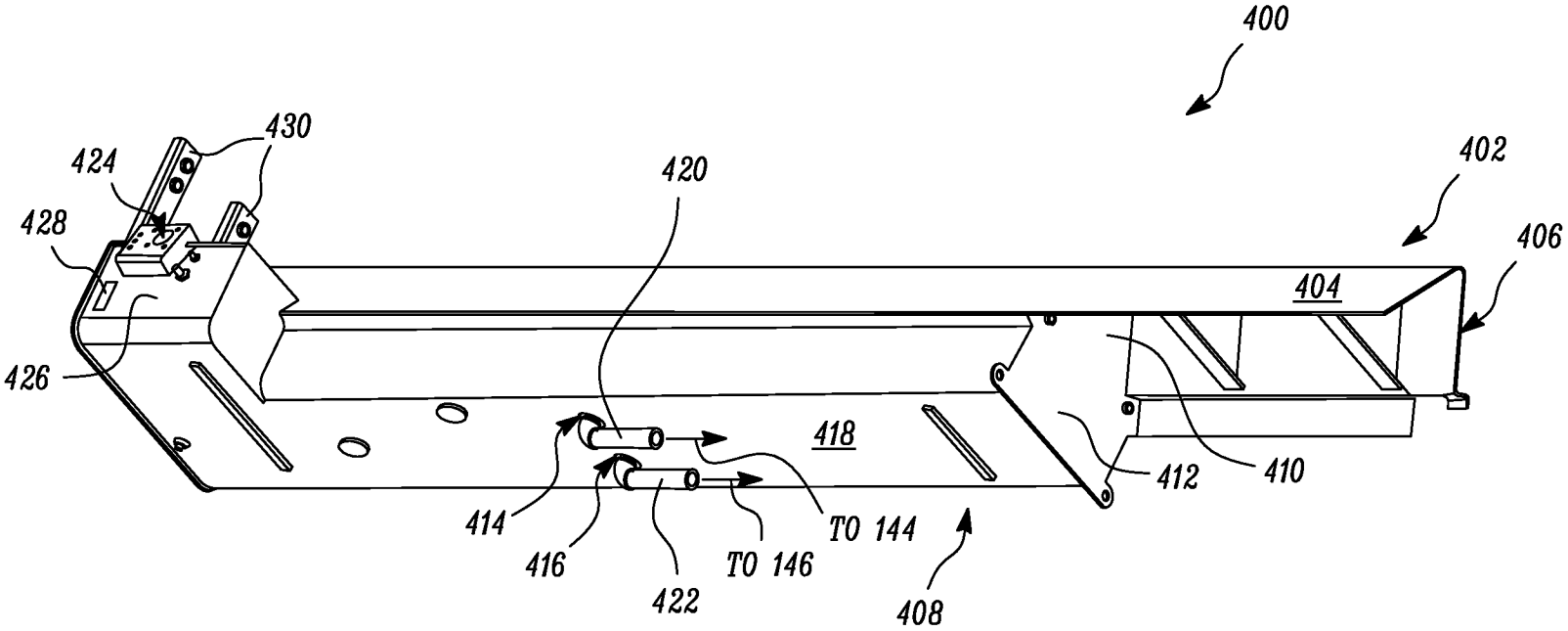
FIG. 5 is a bottom perspective view of the modular assembly of FIG. 4.

Referring to FIGS. 3, 4, and 5, a modular assembly 400 for the heat exchanger 108 is illustrated. The modular assembly 400 is coupled to the hood structure 110. Only a top edge 401 of the modular assembly 400 is visible in FIG. 2, while a portion of the modular assembly 400 is visible in FIG. 3, showing how the modular assembly 400 is arranged with respect to the hood structure 110. FIGS. 4 and 5 show standalone views of the modular assembly 400.

As shown in FIGS. 3, 4 and 5, the modular assembly 400 includes a support assembly 402. In one example, as shown in FIG. 3, a length of the support assembly 402 and a length of the hood structure 110 is the same so that the support assembly 402 sits within the interior space 116 of the hood structure 110. The support assembly 402 is coupled to a base section 120 (see FIG. 3) of the hood structure 110. In one example, the support assembly 402 is coupled to the hood structure 110 by welding. Alternatively, any other joining process may be used to couple the support assembly 402 to the hood structure 110.

The support assembly 402 includes a first slant surface 404 and a second slant surface 406. The first and second slant surfaces 404, 406 are arranged in an inverted "V" type manner. The first and second slant surfaces 404, 406 of the support assembly 402 communicate with the interior space 116 of the hood structure 110 (see FIG. 3). As shown in FIG. 2, the first and second slant surfaces 404, 406 are configured to provide support to at least a portion of the heat exchanger 108. More particularly, the first and second slant surfaces 404, 406 are configured to support bottom surfaces of the heat exchanger 108.

Referring to FIGS. 4 and 5, the modular assembly 400 includes a fluid reservoir 408. The fluid reservoir 408 is configured to store the fluid, such as water, which is circulated through the engine 102 and the heat exchanger 108. The fluid reservoir 408 is fluidly coupled to the engine 102 via the line 144 (see FIG. 1). Further, the fluid reservoir 408 is fluidly coupled to the aftertreatment system 126 via line 146 (see FIG. 1).

Referring to FIG. 5, the fluid reservoir 408 is integrated with and extends from the support assembly 402. The fluid reservoir 408 includes a first section 410 and a second section 412 extending from the first section 410. The first section 410 of the fluid reservoir 408 has a triangular cross section conforming to the first and second slant surfaces 404, 406. Whereas, the second section 412 has a rectangular cross section. The second section 412 of the fluid reservoir 408 stores the fluid therein.

Additionally or optionally, the fluid reservoir 408 may include baffles (not shown) arranged at intervals within the second section 412 of the fluid reservoir 408. It should be noted that the parameters related to the fluid reservoir 408 such as size, shape, location, and material used may vary as function system design and requirements. As shown in the accompanying figures, a length of the fluid reservoir 408 is lesser than the length of the support assembly 402. Alternatively, in one embodiment, the length of the fluid reservoir 408 may be equal to the length of the support assembly 402, based on system requirements.

The fluid reservoir 408 includes a first supply port 414 and a second supply port 416. The first and second supply ports 414, 416 are provided at a bottom surface 418 of the fluid reservoir 408. The first and second supply ports 414, 416 are configured to supply the fluid to the engine cooling circuit and/or the aftertreatment cooling circuit respectively. The first and second supply port 414, 416 is coupled to a first fluid line 420 and a second fluid line 422 respectively. The first fluid line 420 is configured to supply the fluid from the fluid reservoir 408 to the engine cooling circuit via the line 144 (see FIG. 1). Whereas, the second fluid line 422 is configured to supply the fluid to the aftertreatment cooling circuit via the line 146 (see FIG. 1). Further, when the engine 102 is shut down, the fluid within each of the engine cooling circuit and the aftertreatment cooling circuit drains back into the fluid reservoir 408 through the first and second supply ports 414, 416 respectively.

The fluid reservoir 408 includes a fill port 424. The fill port 424 is provided at a side surface 426 of the fluid reservoir 408. When a level of the fluid within the fluid reservoir 408 decreases, the fluid reservoir 408 may be refilled with the fluid through the fill port 424. The fill port 424 may be coupled to an external source of fluid supply (not shown) to refill the fluid reservoir 408. After the refill of the fluid reservoir 408, the fill port 424 may be sealed using a pressure cap (not shown). Further, a sight glass 428 is associated with the fluid reservoir 408. The sight glass 428 may allow an operator or maintenance personnel to view the level of the fluid present within the fluid reservoir 408. The sight glass 428 may be mounted on the side surface 426 of the fluid reservoir 408.

As shown in FIGS. 4 and 5, the modular assembly 400 includes vent lines 430. The vent lines 430 are provided in fluid communication with the fluid reservoir 408 to vent the fluid reservoir 408 of any air trapped therein. Further, the hood structure 110 also includes vent lines 124 (see FIGS. 2 and 3). The vent lines 124 provide fluid communication between the heat exchanger 108 and the fluid reservoir 408. More particularly, the vent lines 124 are configured to vent air or water from the heat exchangers 108 into the vent lines 430 of the modular assembly 400.

INDUSTRIAL APPLICABILITY

The present disclosure describes the modular assembly 400 for the heat exchanger assembly 106. The modular assembly 400 integrates the fluid reservoir 408 associated with the cooling system 104 of the engine system 100 with the support assembly 402. The fluid reservoir 408 disclosed herein has a flexible design and can accommodate more volume of the fluid therein by adjusting a width, a depth, or a length of the fluid reservoir 408.

The design of the modular assembly 400 disclosed herein enables pre-production quality testing of the modular assembly 400 before the modular assembly 400 is incorporated into the hood structure 110. Also, the modular assembly 400 has a compact design and saves compartment space by packaging the fluid reservoir 408 volume tightly into the hood structure 110. Further, the modular assembly 400 has a lightweight structure, thereby reducing the overall engine system weight.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A modular assembly for a heat exchanger, the modular assembly comprising:

a support assembly configured to couple to a base section of a hood structure of the heat exchanger, wherein the support assembly includes a first slant surface and a second slant surface configured to provide support to at least a portion of the heat exchanger; and a fluid reservoir integrated with and extending from the support assembly, the fluid reservoir configured to store a fluid circulated through the heat exchanger, wherein the fluid reservoir includes a first section and a second section extending from the first section, the first section having a triangular cross section and the second section having a rectangular cross section.

2. The modular assembly of claim 1, wherein a length of the fluid reservoir is less than a length of the support assembly.

3. The modular assembly of claim 1, wherein a length of the fluid reservoir is equal to a length of the support assembly.

4. The modular assembly of claim 1, wherein a length of the support assembly and a length of the hood structure are same.

5. The modular assembly of claim 1, wherein the first and second slant surfaces are arranged in an inverted "V" type manner.

6. The modular assembly of claim 1, wherein the fluid reservoir further includes a pair of supply ports and a fill port.

7. The modular assembly of claim 1, wherein the fluid reservoir further includes a plurality of vent lines, the plurality of vent lines configured to provide fluid communication between the heat exchanger and the fluid reservoir.

8. The modular assembly of claim 1 further comprising a sight glass associated with the fluid reservoir.

9. A heat exchanger assembly comprising:

a heat exchanger;

a hood structure defining an interior space, wherein the heat exchanger is received into the interior space of the hood structure; and a modular assembly coupled to the hood structure, the modular assembly comprising:

a support assembly coupled to a base section of the hood structure, wherein the support assembly includes a first slant surface and a second slant surface configured to provide support to at least a portion of the heat exchanger; and a fluid reservoir integrated with and extending from the support assembly, the fluid reservoir configured to store a fluid circulated through the heat exchanger.

10. The heat exchanger assembly of claim 9, wherein the support assembly is coupled to the hood structure by welding.

11. The heat exchanger assembly of claim 9, wherein the first and second slant surfaces of the support assembly communicate with the interior space of the hood structure.

12. The heat exchanger assembly of claim 9, wherein a length of the fluid reservoir is less than a length of the support assembly.

13. The heat exchanger assembly of claim 9, wherein a length of the fluid reservoir is equal to a length of the support assembly.

14. The heat exchanger assembly of claim 9, wherein a length of the support assembly and a length of the hood structure are same.

15. The heat exchanger assembly of claim 9, wherein the first and second slant surfaces are arranged in an inverted "V" type manner.

16. The heat exchanger assembly of claim 9, wherein the fluid reservoir includes a first section and a second section extending from the first section, the first section having a triangular cross section and the second section having a rectangular cross section.

17. The heat exchanger assembly of claim 9 further comprising a plurality of vent lines provided within the interior space of the hood structure, the plurality of vent lines configured to provide fluid communication between the heat exchanger and the fluid reservoir.

18. The heat exchanger assembly of claim 9 further comprising a sight glass associated with the fluid reservoir.

19. An engine system comprising:

an engine;

a heat exchanger;

a hood structure defining an interior space, wherein the heat exchanger is received into the interior space of the hood structure; and a modular assembly coupled to the hood structure, the modular assembly comprising:

a support assembly coupled to a base section of the hood structure, wherein the support assembly includes a first slant surface and a second slant surface configured to provide support to at least a portion of the heat exchanger; and a fluid reservoir integrated with and extending from the support assembly, the fluid reservoir in communication with the engine and the heat exchanger, the fluid reservoir configured to store a fluid circulated through the heat exchanger.

* * * * *